US005914023A

United States Patent [19]

Roy et al.

[11] Patent Number: 5,914,023

[45] Date of Patent: Jun. 22, 1999

[54] ACTUATOR

[75] Inventors: Ronald Keith Roy, Box Hill North, Australia; Peter Jones, Invercargill, New Zealand

[73] Assignees: Terry Fluid Controls Pty Ltd; Comalco Aluminium Limited, both of Australia

[21] Appl. No.: 09/106,116

[22] Filed: Jun. 29, 1998

Related U.S. Application Data

[63] Continuation of application No. 08/765,978, Jan. 15, 1997, abandoned.

[30] Foreign Application Priority Data

Jul. 15, 1994 [AU] Australia ..... PM6831
Apr. 19, 1995 [AU] Australia ..... PN2536

[51] Int. Cl.[6] ..... C25C 3/14

[52] U.S. Cl. ..... 205/392; 204/245; 91/390

[58] Field of Search ..... 91/390, 410; 204/245; 205/392

[56] References Cited

U.S. PATENT DOCUMENTS

| | | | |
|---|---|---|---|
| 2,743,704 | 5/1956 | Banker . | |
| 3,371,026 | 2/1968 | Kiley et al. . | |
| 3,664,946 | 5/1972 | Schaper et al. . | |
| 3,670,628 | 6/1972 | Borer et al. . | |
| 4,053,384 | 10/1977 | Siegmund . | |
| 4,321,115 | 3/1982 | Rebmann et al. | 205/392 |
| 4,407,150 | 10/1983 | Kelly . | |
| 4,563,255 | 1/1986 | Heinzmann et al. . | |
| 4,617,100 | 10/1986 | Boughton . | |
| 4,700,610 | 10/1987 | Bauer et al. . | |
| 4,858,937 | 8/1989 | Fairlie-Clarke et al. . | |
| 5,163,353 | 11/1992 | Horstmann et al. . | |
| 5,237,905 | 8/1993 | Kuttruf . | |
| 5,405,506 | 4/1995 | Kumpulainen | 205/392 |
| 5,476,574 | 12/1995 | Welch et al. | 205/392 |

FOREIGN PATENT DOCUMENTS

| | | |
|---|---|---|
| 26 29 564 A1 | 1/1978 | Germany . |
| 28 50 237 A1 | 5/1980 | Germany . |
| 30 22 490 A1 | 12/1981 | Germany . |
| 2 188 984 | 10/1987 | United Kingdom . |

OTHER PUBLICATIONS

Exhibit D "Piping Diagram For Self–Reciprocating Cyclinders,"(3 pages) (undated). (No Date).

*Primary Examiner*—Donald R. Valentine
*Attorney, Agent, or Firm*—Banner & Witcoff Ltd.

[57] ABSTRACT

An actuator assembly comprises a piston within an actuating cylinder, and a valve for controlling the flow of actuating fluid to the first side of the piston. When the valve is actuated the flow of fluid to the first side of the piston is stopped and the pressure of the actuating fluid on the piston is sufficient to maintain the piston in a predetermined position along the stroke path. Also disclosed is a method of actuating the crust breaker of a smelter pot using the apparatus described. Fluid leakage through the piston rod sealing assembly is reduced; the volume of compressed air used by the smelter is reduced; and the working life of the actuator is improved.

28 Claims, 2 Drawing Sheets

ACTUATOR

This application is a continuation of application Ser. No. 08/765,978, filed Jan. 15, 1997, now abandoned.

The present invention relates to an improved actuator configuration and in an embodiment to an actuator configuration of the type used to drive a crustbreaker of a smelter pot. The invention also relates to an improved method of operating a crustbreaker actuator.

During the smelting process of aluminium a crust forms on the top of the smelter pot. When additional material is to be added to the smelter pot, a crustbreaker must be driven into the smelter pot to break up the crust formed thereon. Traditionally, a smelter will have a very large number of smelter pots in operation at any one time. Each pot has one or more picks or crustbreakers positioned thereabove which are arranged to be driven by an actuator through the crust on the pot. The actuators of the pots are conventionally pneumatically driven and typically make use of compressed air at a system pressure of about 100 pounds per square inch (psi). A system driving pressure of approximately 100 psi is typically used to break the crust and to ensure release of the pick or crustbreaker from the pot after it has penetrated the crust formed thereon. Although it has been realised for some time that significant force/pressure was required to break the pick or crustbreaker free of the crust, and more recently that once free, a lower pressure would return the pick or crustbreaker to its retracted position, a method of having two different pressures that would work efficiently to operate the pick or crustbreaker assembly has until now not been developed.

The present invention proposes, in an advantageous application to the crustbreaker case, that the supply of driving fluid (e.g. compressed air) to the actuator which drives the crustbreaker be shut off once the crustbreaker has been released from the crust on the pot and reaches a position essentially retracted from the pot. In this manner, an immense saving can be achieved in the volume of compressed air required to operate the crustbreaker of a typical smelter. This results in a substantial energy saving and therefore reduces overall smelter costs. Furthermore, it has been found that because the pressure in the cylinder of the actuator is very much reduced (around 25 psi), there is far less fluid leakage through the piston rod sealing assembly. This again reduces the volume of compressed air used by the smelter and is believed to result in an improved working life of the actuators.

Although the present invention is seen to have particular application in actuators for smelter pot crustbreakers, the invention is envisaged to have other broader applications, and thus according to a first aspect of the present invention there is provided an actuator configuration including:

- an actuating cylinder having a piston arranged to be driven along a stroke path therewithin;
- a valve means for controlling the flow of actuating fluid to a first side of the piston; and
- means responsive to the piston reaching a predetermined point along the stroke path to actuate the valve means whereby to stop the flow of actuating fluid to the first side of the piston;
- wherein the pressure of said actuating fluid on said first side of said piston upon actuation of said valve means is at least sufficient to substantially maintain said piston in a first predetermined position along the stroke path.

Preferably, the pressure of said actuating fluid on said first side of said piston when said valve means is actuated is a reduced pressure as compared to a system pressure applied to a second side of said piston when said piston is being driven to a second predetermined position along the stroke path.

Preferably, the valve means is mounted within said actuating cylinder.

Preferably, the valve means is arranged such that if there is leakage of said actuating fluid from said first side of the piston, said valve means will operate to provide a flow of actuating fluid to said first side of the piston to compensate for said leakage.

Preferably, said responsive means includes a portion of said valve means engaged by said piston when at said predetermined point whereby to hold said valve means in a position where the flow of actuating fluid to said first side of said piston is stopped. Preferably if there is a leakage of actuating fluid from said first side of said piston, the piston moves and disengages from said portion of said valve means, whereby said valve means allows a flow of actuating fluid to said first side of said piston to thereby maintain said piston substantially at or adjacent said first predetermined position and thereby prevents inadvertent stroking of said piston.

In one preferred embodiment of the invention, the actuator configuration is a crustbreaker actuating cylinder and the piston is connected to a piston rod which is connected to or integrally formed with a device for breaking the crust on a smelter pot.

Preferably, said valve means comprises a poppet valve having a stem arranged to contact said piston when it is located at the first predetermined position.

In a second aspect of the invention there is provided a method of operating a crustbreaker actuator of a smelter pot including:

- providing a flow of actuating fluid to one said of a piston of said actuator so as to drive said piston toward said pot and thereby to drive a crustbreaker through the crust of said pot,
- providing a flow of actuating fluid to another side of said piston so as to drive said piston away from said pot and to release said crustbreaker from the crust of said pot, and
- stopping the flow of actuating fluid to said other side of said piston once said crustbreaker reaches a predetermined point along the stroke path of the piston, wherein the pressure of said actuating fluid on said other side of the piston after said stopping of the flow is at least sufficient to substantially maintain said piston in a first predetermined position along the stroke path.

Preferably, the flow of actuating fluid to said other side is stopped by triggering a valve means which controls the flow of actuating fluid to said other side.

Preferably, means is provided to control the rate of flow of actuating fluid to said other side of said piston. Preferably, the control means comprises a check valve or an adjustable control valve which acts as a restrictor when said crustbreaker is being released from said pot and which enables fast exhaust when said crustbreaker is driven towards said pot.

An embodiment of the invention will now be described by way of example only with reference to the accompanying drawings in which.

Figure 1:
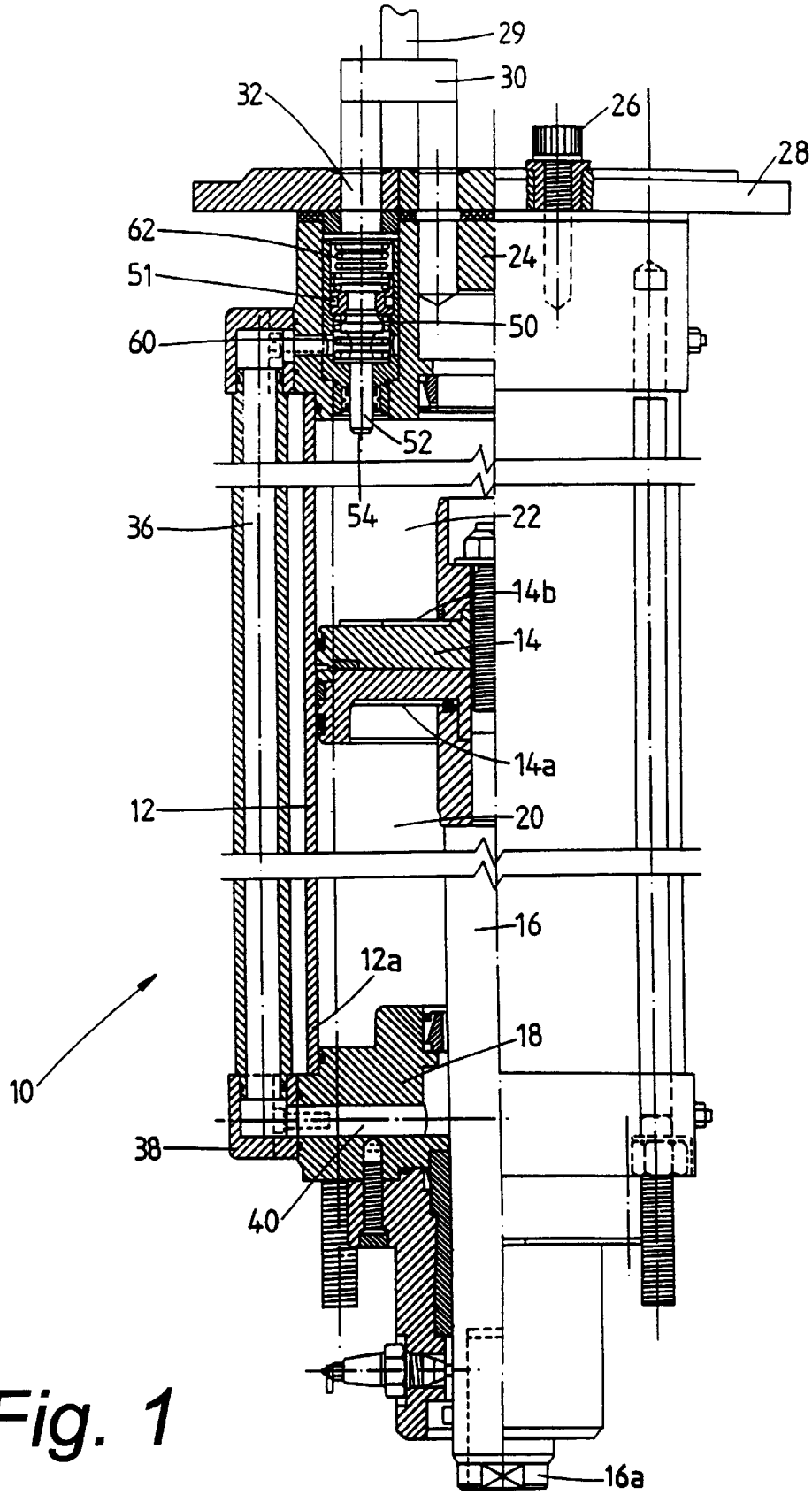
FIG. 1 is a partial cross-sectional view of a crustbreaker actuator fitted with a poppet valve according to an embodiment of the invention.

The crustbreaker actuating cylinder 10 comprises a piston barrel 12, a piston 14 arranged for movement along a stroke path within the piston barrel 12 and a piston rod 16 connected to the piston 14. The lower end 16*a* of the piston rod 16 extends through an end cap 18 attached to the lower end 12*a* of the piston barrel 12. Attached to or integrally formed with the lower end 16*a* of the piston rod is a crustbreaker or pick (not shown).

A first chamber 20 is defined by the inner wall of the piston barrel 12, the upper face of the front end cap 18 and the lower side 14*a* of the piston 14. A second chamber 22 is defined by the inner wall of the piston barrel 12, the upper side 14*b* of the piston 14 and the lower face of the rear end cap 24. The rear end cap 24 is secured by connectors 26 to a mounting plate 28. Mounted on the mounting plate 28 is the supply 29 of actuating fluid which in this case is compressed air. The compressed air supply 29 is at a system pressure of about 100 psi. A directional control valve 30 controls the flow of compressed air into the first and second chambers 20, 22.

Compressed air from the actuating fluid source can be transferred to the first chamber 20 via a passage 32 in the rear end cap 24, via a transfer tube 36, through an air inlet manifold 38 attached to the front end cap 18 and then via a passage 40 in the end cap 18.

To drive the crustbreaker through the crust on a smelter pot the piston 14 must be actuated to drive the piston rod 16 towards the pot. The piston 14 is driven towards the pot by providing a supply of compressed air to the second chamber 22. To raise the crustbreaker away from the pot, the second air chamber 22 is vented and then a supply of compressed air is provided to the first chamber 20. The supply of compressed air into chamber 20 will cause the piston 14 to move towards the rear end cap 24 thereby lifting the piston rod 16 and attached crustbreaker away from the smelter pot.

Mounted within the passage 32 in the rear end cap 24 is a poppet valve 50. Poppet valve 50 can be triggered to engage against a valve seat 51 to thereby close off the passage 32 so as to prevent further compressed air from passing into transfer tube 36, while also maintaining the volume of compressed air within transfer tube 36, manifold 38, passage 40 and first chamber 20. The poppet valve 50 includes a stem 52 having an end 54 which extends into the second chamber 22.

As stated previously, the crustbreaker of the actuator 10 can be driven into the pot by providing a flow of compressed air into the second chamber 22. Typically, the compressed air supplied to the second chamber 22 would be at a pressure in the order of 100 psi. This pressure is desirable in order to provide sufficient driving force to the piston 14 to enable the crustbreaker to pierce through the crust on the smelter pot. To release the crustbreaker from the smelter pot, the second chamber 22 is evacuated and compressed air is passed into the first chamber 20. In order to extract the crustbreaker from the pot, the compressed air within the first chamber 20 is generally initially at a pressure of, for example, about 100 psi. This pressure provides sufficient driving force to the piston 14 to extract the crustbreaker from the crust and to raise the piston rod 16 to a position at which the crustbreaker is free from the pot and any crust. However, once the crustbreaker has reached this free position, it has been found that the pressure in chamber 20 actually required to then raise the piston 14 to a point at which the crustbreaker is well clear from the pot and to hold the piston 14 in this position, is substantially reduced when compared to the initial driving pressure required. Typically, the required reduced pressure is around 25 psi. Therefore, after extraction of the crustbreaker it is not necessary to continue to supply compressed air into the first chamber 20 so as to bring the pressure in transfer tube 36, the air inlet manifold 38, the passage 40 and the first chamber 20 up to the initial driving system pressure of 100 psi. Accordingly, a check valve 100 (not shown in FIG. 1) having a limited flow orifice can be included in the supply line between the directional control valve 30 and passage 32. The check valve being arranged to limit or restrict the rate of compressed air flow into the first chamber 20 and to allow free flow of air when the first chamber 20 is exhausted. In this way, the rate of flow of compressed air into the first chamber 20 will be reduced and thereby the amount of unnecessary air admitted into the first chamber between the time that the crust breaker is cleared from the crust and when the poppet valve 50 is actuated to stop the flow of compressed air into the first chamber 20, will be minimised. As an alternative to such a check valve, an adjustable inline flow control valve could be used, or a restricted orifice could be incorporated within the structure of the directional control valve 30.

Figure 2:
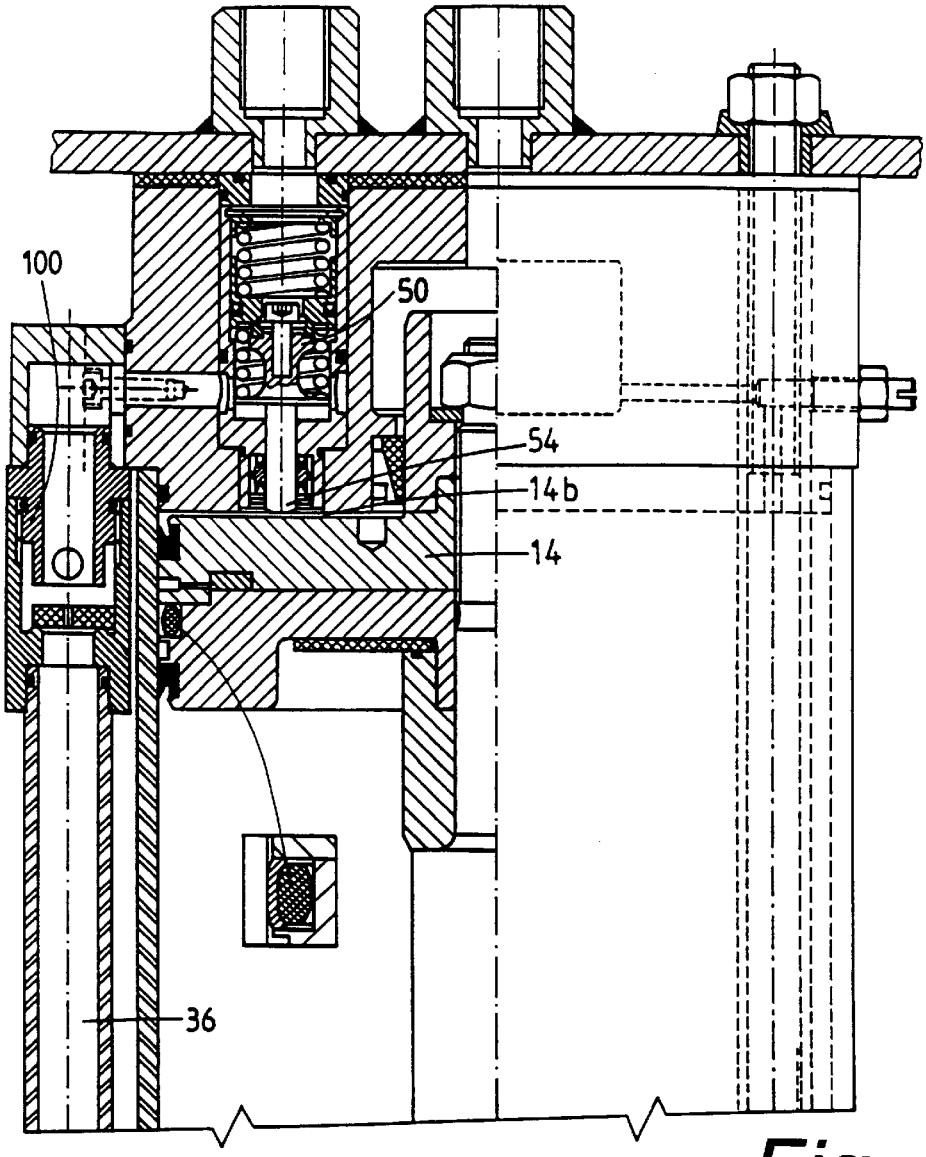
FIG. 2 is a partial cross-sectional view of a crustbreaker actuator fitted with a poppet valve and a check valve according to another embodiment of the invention.
Figure 3:
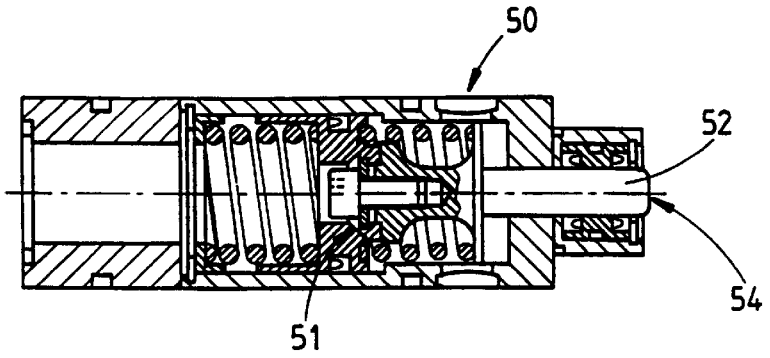
FIG. 3 is an enlarged view of the poppet valve shown in FIGS. 1 and 2.

FIG. 2 illustrates another alternative arrangement wherein the check valve 100 is located at the top of the transfer tube 36. This arrangement is advantageous as it makes the crust breaker unit more compact.

The present inventors have determined that the reduced pressure in first chamber 20 which is due to system lag and the inertia of the piston 14 is sufficient to drive the piston 14 upwardly until the upper side 14*b* of the piston 14 contacts the end 54 of the poppet valve stem 52. When the upperside 14*b* of the piston 14 contacts the end 54 of the poppet valve 50 (FIG. 2), the valve 50 engages in valve seat 51 to close off the supply of compressed air to the first chamber 20. As the piston 14 may strike the end 54 of the poppet valve 50 with considerable momentum, the poppet valve 50 is mounted within the passage 32 in a manner whereby some axial movement of the poppet valve 50 is permissible. In this particular embodiment, the poppet valve 50 and seat 51 are held in relative position within the passage 32 by a pair of springs 60, 62.

The pressure applied by the upper side 14*b* of the piston 14 against the end 54 of the poppet valve 50 is sufficient to hold the poppet valve 50 against the seat 51 thereby maintaining the volume of compressed air 14 within the transfer tube 36 and first chamber 20. If the upper side 14*b* of the piston 14 falls away from the end 54 of the poppet valve 50, because of an inadvertent loss of pressure within the first chamber 20, the poppet valve 50 is released from the valve seat 51 allowing compressed air to bleed into the transfer tube 36 thereby topping up the pressure in the first chamber 20. In this manner, the piston 14 can be maintained substantially at the uppermost first predetermined position of its stroke path.

The crustbreaker actuator 10 described is particularly advantageous as it enables the amount of compressed air used by the actuator 10 to be significantly reduced. In a smelter having two thousand or so such crustbreaker actuators this saving in compressed air results in a significant overall cost saving. Furthermore, because the pressure within the second chamber 20 is considerably reduced once the crustbreaker is free from the pot, there is typically less leakage of compressed air through the seals of the actuator than would normally occur using compressed air at higher pressures. As there is therefore less leakage of compressed air the embodiment provides an even greater overall saving in compressed air usage.

In a typical installation using a 100 psi of line air pressure to operate the cylinders, embodiments of the present invention will reduce the residual pressure at the end of the stroke in a cylinder retracting from the pot to around 25 to 35 psi, depending on the bore of the cylinder, the speed of the retraction, the weight of the structure it is lifting such as the pick and the feeder assembly and the degree of cushioning required to avoid structural damage.

Although the poppet valve 50 in the present embodiment has been mounted adjacent the upper end of the actuator 10 it is envisaged that the valve 50 could be positioned at other locations. The location of the poppet valve 50 as described is seen to be particularly convenient as in most smelters the supply of compressed air is normally positioned well above the pot. Furthermore, although the actuator and valve arrangement has been described in connection with an actuator for a crustbreaker it is envisaged that the valve arrangement and/or actuator could be used in other applications. The use of different forms of valves is also envisaged. Such valves may be mounted internally or externally of the actuator and may be triggered remotely from the piston, by the piston rod or other means initiated for example, by the piston, the piston rod or another mechanism.

The embodiments have been described by way of example only and modifications are possible within the scope of the invention.

We claim:

1. An actuator configuration including:

an actuating cylinder having a piston arranged to be driven by actuating fluid along a stroke path therewithin;

a valve means for controlling the flow of actuating fluid to a first side of the piston; and means responsive to the piston reaching a predetermined point along the stroke path to actuate the valve means to stop the flow of actuating fluid to the first side of the piston;

wherein the pressure of said actuating fluid on said first side of said piston upon actuation of said valve means is at least sufficient to substantially maintain said piston in a first predetermined position along the stroke path, and is a reduced pressure as compared to a system pressure able to be applied to a second side of said piston to drive said piston in the opposite direction along the stroke path.

2. An actuator configuration according to claim 1, wherein the valve means is arranged such that if there is leakage of said actuating fluid from said first side of the piston, said valve means will operate to provide a flow of actuating fluid to said first side of the piston to compensate for said leakage.

3. An actuator configuration according to claim 1, wherein said responsive means includes a portion of said valve means engaged by said piston when at said predetermined point to hold said valve means in a position where the flow of actuating fluid to said first side of said piston is stopped.

4. An actuator configuration according to claim 3, wherein said valve means is arranged to allow a flow of actuating fluid to said first side of said piston whenever said piston is disengaged from said portion of said valve means, whereby if there is a leakage of actuating fluid from said first side of said piston which would allow said piston to move and disengage from said portion of said valve means, actuating fluid would flow to said first side of said piston to maintain said piston substantially at or adjacent said first predetermined position and thereby prevent inadvertent stroking of said piston.

5. An actuator configuration according to claim 3, wherein said valve means includes a poppet valve and said portion of said responsive means includes a stem arranged to be contacted by said piston when it is located at said predetermined point.

6. An actuator configuration according to claim 1, wherein the valve means is mounted within said actuating cylinder.

7. An actuator configuration according to claim 1, wherein the actuating cylinder is a crust breaker actuating cylinder and the piston is connected to a piston rod which is connected to or integrally formed with a device for breaking the crust on a smelter pot.

8. An actuator configuration according to claim 1 further comprising means to control the rate of flow of actuating fluid to said first side of said piston.

9. An actuator configuration according to claim 8, wherein the control means comprises a check valve, a restrictor or an adjustable control valve which acts as a restrictor when the actuating fluid is flowing to said first side of said piston, and which enables fast exhaust when the actuating fluid is flowing to said second side of said piston.

10. An actuator configuration according to claim 1, wherein said predetermined point is at or adjacent an end of the stroke path of the piston.

11. An actuator configuration according to claim 1, wherein the responsive means acts remotely from the piston, triggered by the piston or otherwise.

12. An actuator configuration according to claim 11, wherein if there is a leakage of actuating fluid from said first side of said piston, said piston moves and said valve means responds thereto to allow a flow of actuating fluid to said first side of said piston to thereby maintain said piston substantially at or adjacent said first predetermined position and thereby to prevent inadvertent stroking of said piston.

13. A method of operating a crust breaker actuator of a smelter pot including:

providing a flow of actuating fluid at a system pressure to one side of a piston of said actuator so as to drive said piston toward said pot and thereby to drive a crust breaker through the crust of said pot;

providing a flow of actuating fluid to another side of said piston so as to drive said piston away from said pot and to release said crust breaker from the crust of said pot; and stopping the flow of actuating fluid to said other side of said piston once said crust breaker reaches a predetermined point along the stroke path of the piston, wherein the pressure of said actuating fluid on said other side of the piston after said stopping of the flow is at least sufficient to substantially maintain said piston in a first predetermined position along the stroke path, and is a reduced pressure compared to said system pressure of the actuating fluid.

14. A method according to claim 13 wherein the flow of actuating fluid to said other side is stopped by triggering a valve means which controls the flow of actuating fluid to said other side.

15. A crustbreaker actuator configuration including:

a crustbreaker actuating cylinder having a piston arranged to be driven by compressed air along a stroke path therewithin, said piston being connected to a piston rod which is connected to or integrally formed with a device for breaking the crust in a smelter pot when the piston is driven by compressed air in a first direction along said stroke path;

conduit means by which compressed air is delivered during operation to a first side of the piston, including valve means for controlling the flow of the compressed air to said first side of the piston, which flow is effective to drive the piston in a second direction opposite said first direction for retracting said crust breaking device from the crust;

means responsive to the piston reaching a predetermined point when traveling in said second direction along the stroke path to actuate the valve means whereby to stop the flow of air to said first side of the piston, at which predetermined point said crust breaking device is clear of the crust; and wherein the conduit means is such that the pressure of said air on said first side of said piston upon actuation of said valve means is at least sufficient to substantially maintain said piston in a first predetermined position along the stroke path and thus maintain said crust breaking device in a position clear of the crust.

16. A crustbreaker actuator configuration according to claim 15, wherein the pressure of said air on said first side of said piston upon actuation of said valve means is reduced pressure as compared to a system pressure able to be applied to a second side of said piston to drive said piston in said first direction along the stroke path.

17. A crustbreaker actuator configuration according to claim 15, wherein the valve means is arranged such that if there is leakage of said compressed air from said first side of the piston, said valve means will operate to provide a flow of compressed air to said first side of the piston to compensate for said leakage.

18. A crustbreaker configuration according to claim 15, wherein said responsive means includes a portion of said valve means engaged by said piston when at said predetermined point whereby to hold said valve means in a position where the flow of compressed air to said first side of said piston is stopped.

19. A crustbreaker actuator configuration according to claim 18, wherein said valve means includes a poppet valve and said portion of said responsive means includes a stem arranged to be contracted by said piston when it is located at said predetermined point.

20. A crustbreaker actuator configuration according to claim 18, wherein if there is a leakage of compressed air from said first side of said piston, said piston moves and disengages from said portion of said valve means, whereby said valve means allows a flow of compressed air to said first side of said piston to thereby maintain said piston substantially at or adjacent said first predetermined position and thereby prevents inadvertent stroking of said piston.

21. A crustbreaker actuator configuration according to claim 15, wherein the valve means is mounted within said actuating cylinder.

22. A crustbreaker actuator configuration according to claim 15, wherein said conduit means includes means to control the rate of flow of said compressed air to said first side of said piston.

23. A crustbreaker configuration according to claim 22, wherein the control means comprises a check valve, a restrictor or an adjustable control valve which acts as a restrictor when said crustbreaking device is being retracted from said pot and which enables fast exhaust when said crustbreaking device is driven towards said pot.

24. A crustbreaker configuration according to claim 15, wherein said predetermined point is at or adjacent an end of the stroke path of the piston.

25. A crustbreaker configuration according to claim 15, wherein the responsive means acts remotely from the piston, triggered by the piston or otherwise.

26. A crustbreaker configuration according to claim 25, wherein if there is a leakage of compressed air from said first side of said piston, said piston moves and said valve means responds thereto to allow a flow of compressed air to said first side of said piston to thereby maintain said piston substantially at or adjacent said first predetermined position and thereby to prevent inadvertent stroking of said piston.

27. A method of operating a crustbreaker actuator of a smelter pot including:

providing a flow of compressed air to one side of a piston of said actuator so as to drive said piston toward said pot and thereby to drive a crustbreaker device through the crust of said pot;

providing a flow of compressed air to another side of said piston so as to drive said piston away from said pot and to release said crustbreaker device from the crust of said pot; and stopping the flow of compressed air to said other side of said piston once said crustbreaker device reaches a predetermined point along the stroke path of the piston, wherein the pressure of said compressed air on said other side of the piston after said stopping of the flow is at least sufficient to substantially maintain said piston in a first predetermined position along the stroke path.

28. A method according to claim 27, wherein the flow of compressed air to said other side is stopped by triggering a valve means which controls the flow of compressed air to said other side.

* * * * *

UNITED STATES PATENT AND TRADEMARK OFFICE

CERTIFICATE OF CORRECTION

PATENT NO. : 5,914,023
DATED : June 22, 1999
INVENTOR(S) : Ronald Keith Roy and Peter Jones It is certified that error appears in the above-identified patent and that said Letters Patent is hereby corrected as shown below:

Column 1,
Line [63] change "Jan. 15, 1997," to -- May 11, 1995 --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*